US010125994B1

(12) United States Patent
Westrude et al.

(10) Patent No.: US 10,125,994 B1
(45) Date of Patent: Nov. 13, 2018

(54) AESTHETIC ENHANCEMENT APPARATUS AND METHOD

(71) Applicants: Phillip J. Westrude, Lakeville, MN (US); Anthony T. Westrude, Prior Lake, MN (US)

(72) Inventors: Phillip J. Westrude, Lakeville, MN (US); Anthony T. Westrude, Prior Lake, MN (US)

( * ) Notice: Subject to any disclaimer, the term of this patent is extended or adjusted under 35 U.S.C. 154(b) by 415 days.

(21) Appl. No.: 14/866,906

(22) Filed: Sep. 26, 2015

Related U.S. Application Data

(60) Provisional application No. 62/071,509, filed on Sep. 26, 2014.

(51) Int. Cl.
*F24B 1/191* (2006.01)
*F24B 1/18* (2006.01)

(52) U.S. Cl.
CPC ..... *F24B 1/191* (2013.01); *F24B 1/1808* (2013.01)

(58) Field of Classification Search
CPC ..... F24B 1/191; F24B 1/1808; F24B 1/198; B05B 17/08
See application file for complete search history.

(56) References Cited

U.S. PATENT DOCUMENTS

| | | | | |
|---|---|---|---|---|
| 2,109,255 | A | 2/1938 | Mapson | |
| 2,120,653 | A | 6/1938 | Sliger | |
| 3,830,217 | A * | 8/1974 | Maness | F24B 1/1808 126/503 |
| 4,572,598 | A | 2/1986 | Moore, Jr. | |
| 5,184,886 | A | 2/1993 | Handley et al. | |

FOREIGN PATENT DOCUMENTS

| | | |
|---|---|---|
| JP | 2008107010 | 5/2008 |
| UA | 2418517 | 3/2006 |

OTHER PUBLICATIONS

Rainforest Cafe Bar Web Page; http://www.flickr.com/photos/lizcroteau/177300716/; Mar. 19, 2013.

* cited by examiner

*Primary Examiner* — Alfred Basichas
(74) *Attorney, Agent, or Firm* — Richard John Bartz

(57) ABSTRACT

An apparatus and method for aesthetic enhancement of indoor and outdoor living spaces combines fire, bubbling water and light reflection to foster enjoyment and relaxation. Wall assemblies having glass panes are spaced apart from each other to provide a chamber to hold water separate from a burner assembly. Air pumped into the water forms air bubbles in the water. A LED light strip illuminates the water, bubbles and glass panes in changing colors.

14 Claims, 8 Drawing Sheets

AESTHETIC ENHANCEMENT APPARATUS AND METHOD

CROSS REFERENCE TO RELATED APPLICATION

This application claims the priority of U.S. Application Ser. No. 62/071,509 filed Sep. 26, 2014.

FIELD OF THE INVENTION

The invention is in the field of devices and methods for aesthetically enhancing living spaces characterized by water, fire, air bubbles and light.

BACKGROUND OF THE INVENTION

It is desirable to create atmosphere and ambience associated with a particular place, person or thing useable in outdoor and indoor living spaces. Backyard fires are a part of summer and are enjoyable and relaxing. Fire extends outdoor living seasons beyond the summer months by warming outdoor spaces. Fire tables having a visual flame that moves on top of a bed of fire glass are known to enhance the décor of outdoor patios, backyards and commercial establishments transforming these areas into warm and entertaining settings.

SUMMARY OF THE INVENTION

The aesthetic enhancement apparatus for a living space has a frame member adapted to be mounted on a support surface such as a table top. A first wall assembly and a second wall assembly laterally spaced from the first wall assembly are joined to the frame member to define a chamber for holding a liquid. A sealant located on adjacent end portions of the first and second wall assemblies and the frame member functions to prevent leakage of liquid from the chamber. The apparatus has a burner assembly mounted on the frame member and is surrounded by the first wall assembly. A tube member connected to an air supply is located in the chamber whereby air from the air supply is released into the liquid in the chamber to form air bubbles in the liquid. A light source connected to a power supply located in the chamber is operable to illuminate the first and second wall assemblies, air bubbles in the chamber and liquid in the chamber to create ambience and a relaxing atmosphere in the living space.

DESCRIPTION OF THE INVENTION

In the following detailed descriptions of the aesthetic enhancement apparatus, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The aesthetic enhancement apparatus is herein described as used in indoor and outdoor environments. The aesthetic enhancement apparatus can have uses other than aesthetic enhancement uses.

Figure 1:
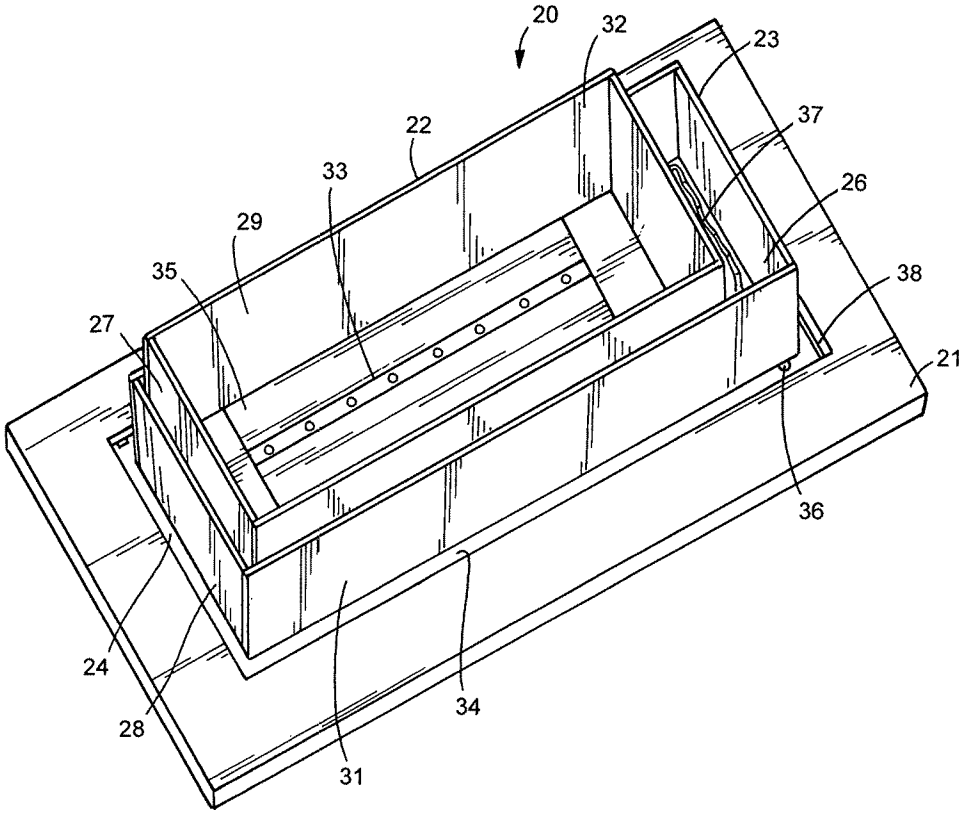
FIG. 1 is a perspective view of an aesthetic enhancement apparatus of the invention mounted on a table top.
Figure 2:
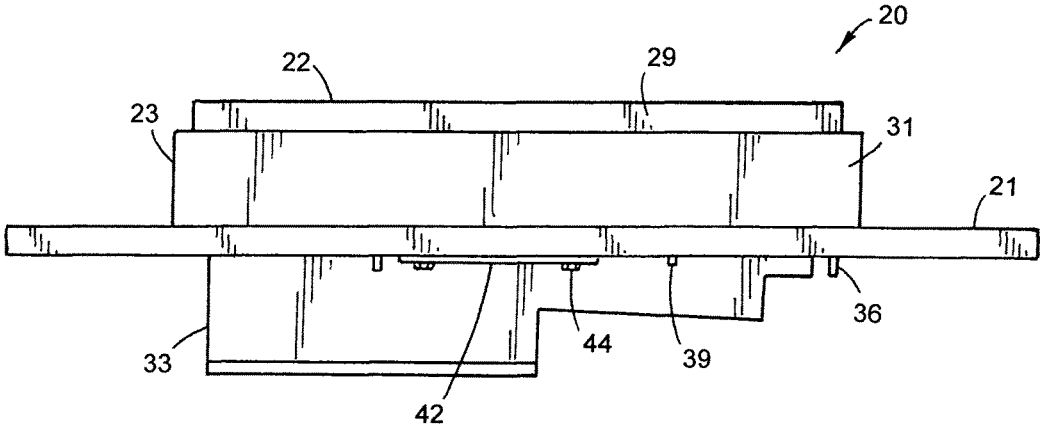
FIG. 2 is an elevated front plan view of FIG. 1.
Figure 3:
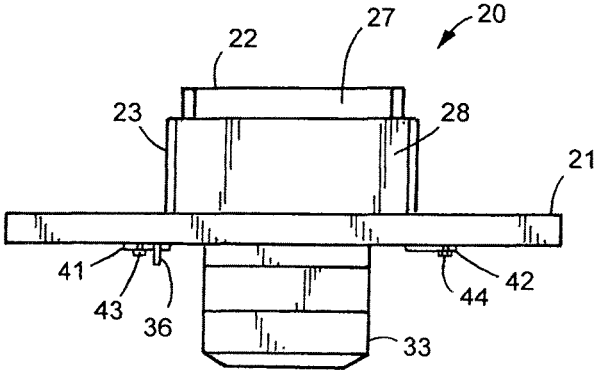
FIG. 3 is an elevated side view of FIG. 1.
Figure 4:
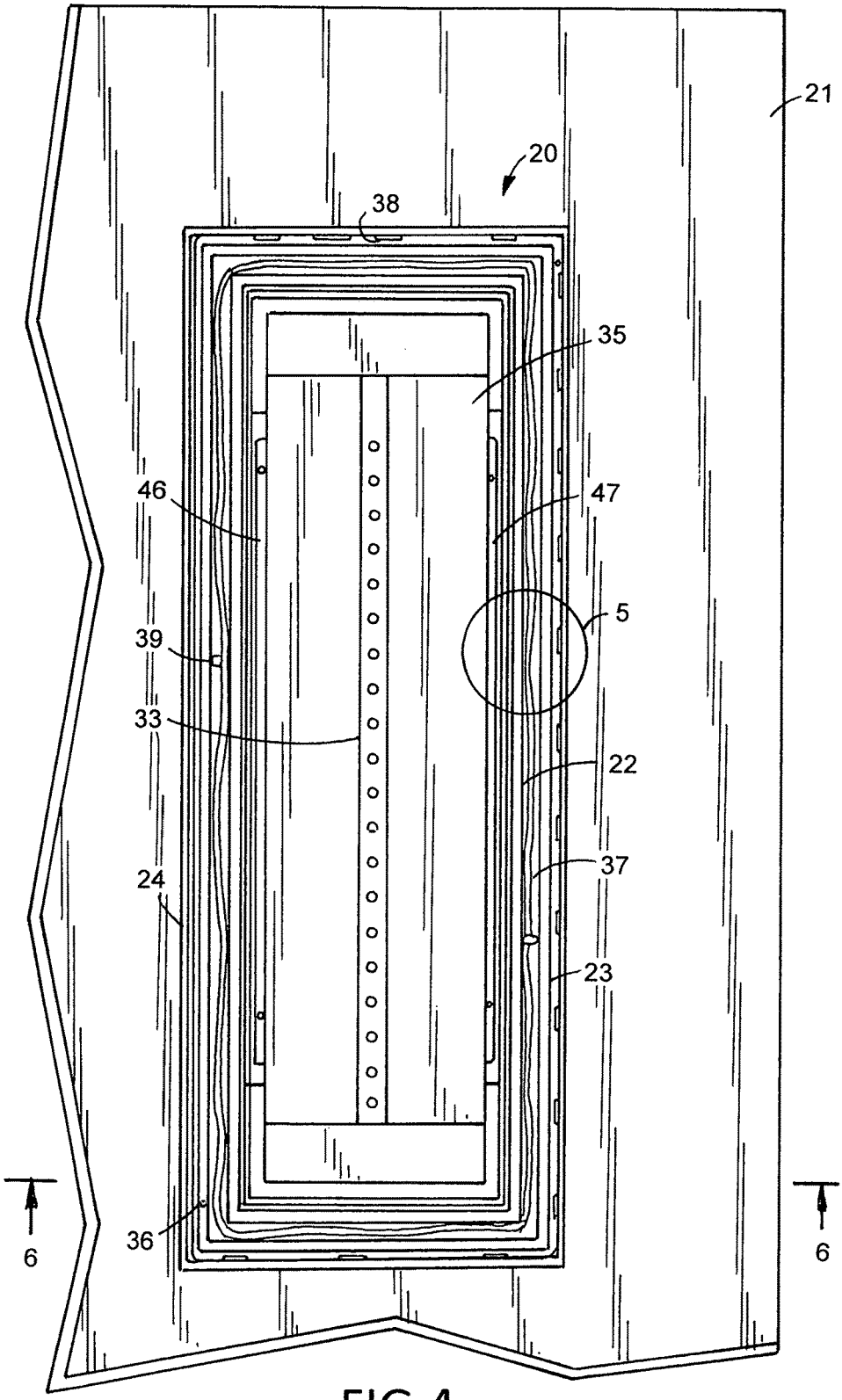
FIG. 4 is a top plan view of FIG. 1.
Figure 5:
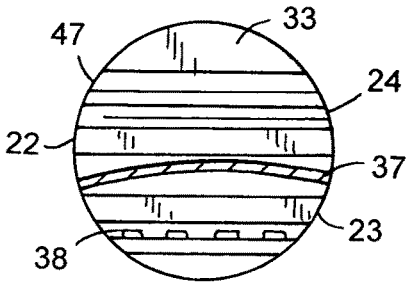
FIG. 5 is an enlarged sectional view of Area 5 of FIG. 4.
Figure 6:
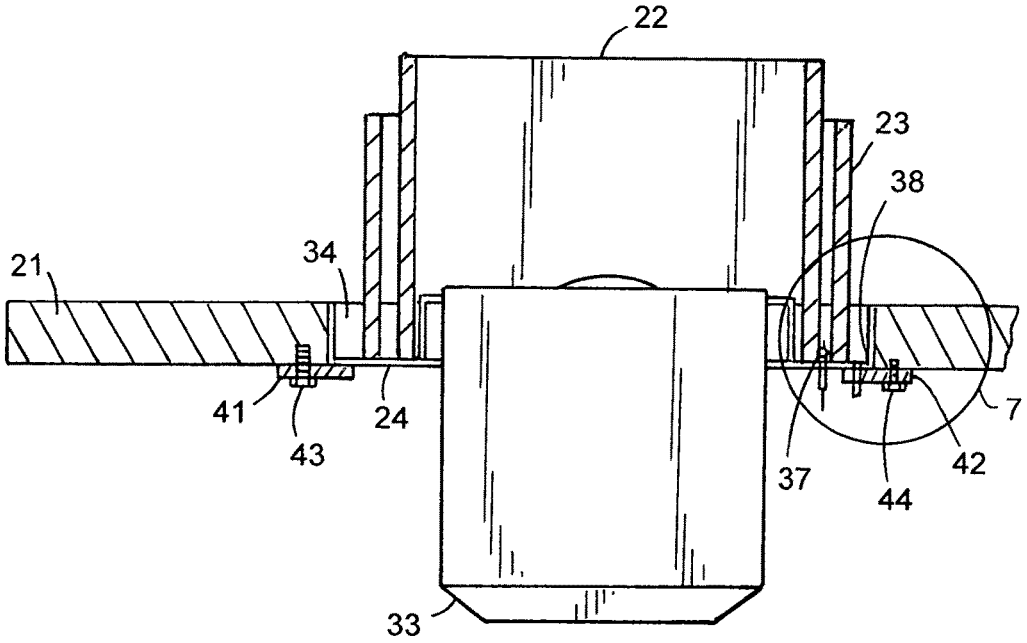
FIG. 6 is an enlarged sectional view taken along line 6-6 of FIG. 4.
Figure 7:
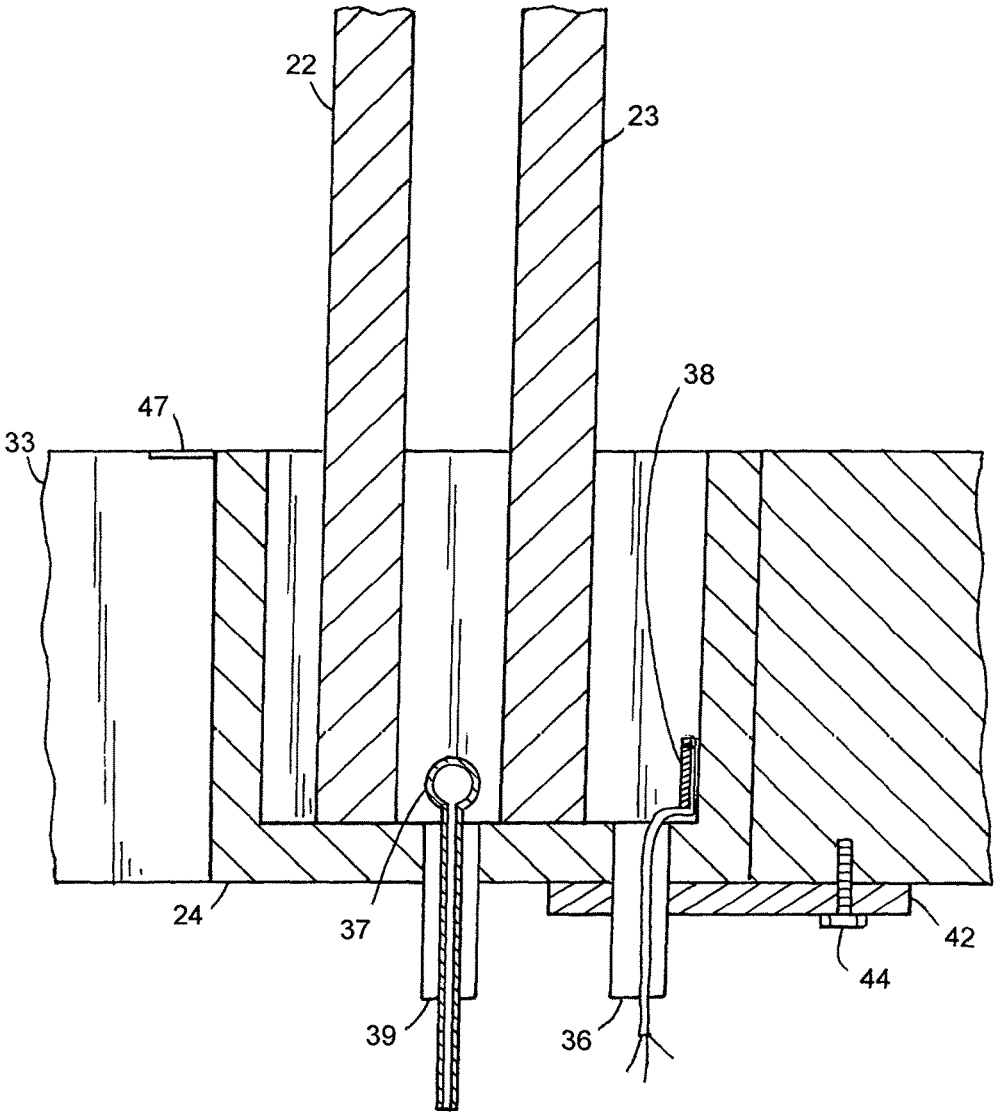
FIG. 7 is an enlarged sectional view of Area 7 of FIG. 6.
Figure 8:
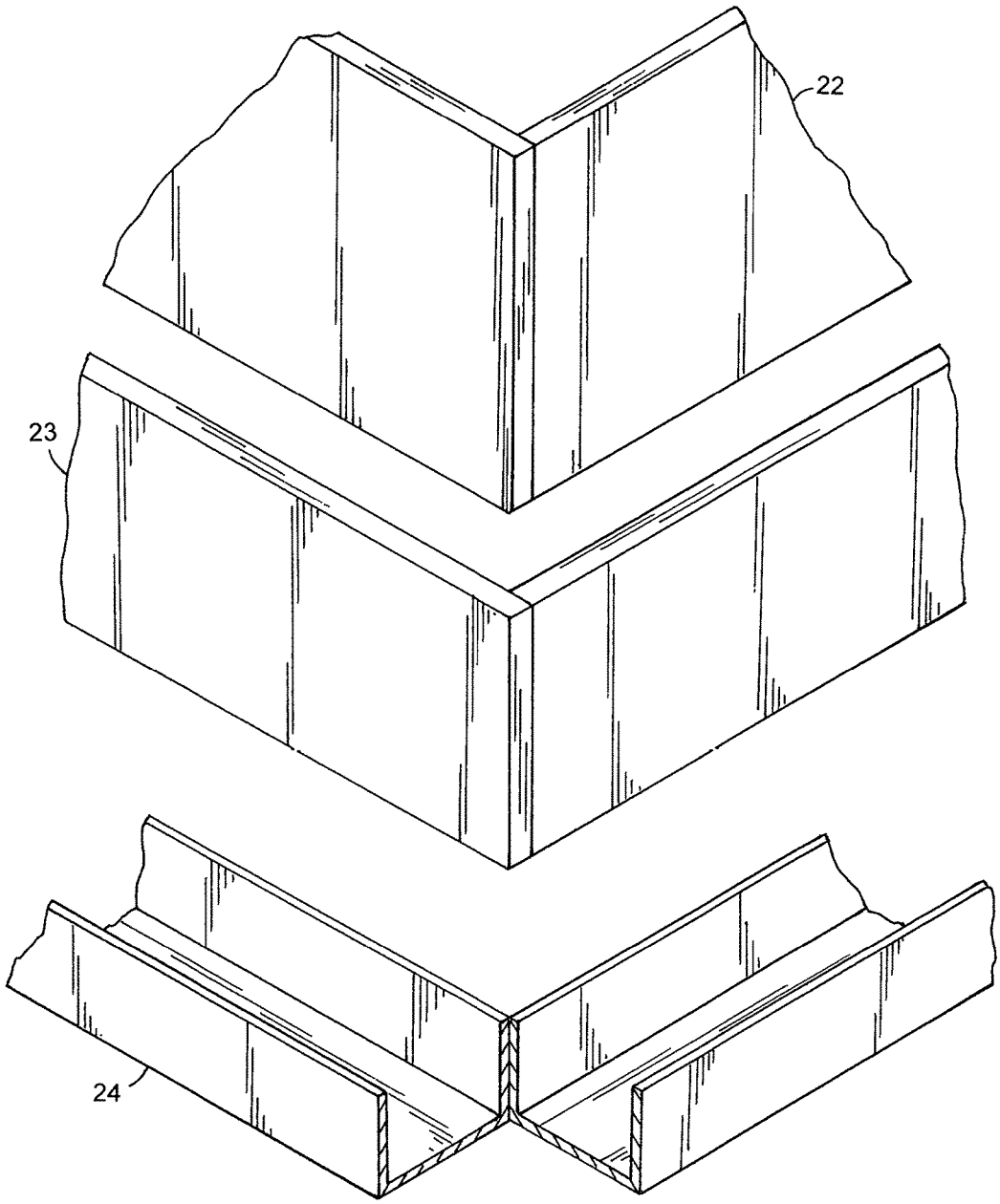
FIG. 8 is an exploded view of the wall assemblies of the aesthetic enhancement apparatus of FIG. 1.

Referring to FIGS. 1 to 8 there is shown an aesthetic enhancement apparatus indicated generally at 20 useable to create atmosphere and ambience in outdoor living spaces such as patios, backyards and the like. Aesthetic enhancement apparatus 20 is shown mounted to an elevated table top 21 having a generally flat upper surface with a central opening. Apparatus 20 can be mounted on or inserted into other types of tables and items such as retaining walls, outdoor fireplaces and countertops.

Aesthetic enhancement apparatus 20 has a channel shaped frame 24 adapted to fit within the central opening of table top 21. Ledges 41 and 42 projecting outwardly from the bottom of frame 24 adjacent the bottom of table top 21 are fastened to table top 21 with fasteners 43 and 44 to mount apparatus to table top 21.

Aesthetic enhancement apparatus 20 has inner and outer laterally spaced upright wall assemblies 22 and 23 joined to the bottom of frame 24 to define a chamber 26 for holding liquid such as water. Wall assemblies 22 and 23 each have end walls 27 and 28 and side walls 29 and 31 joined together to form generally rectangular-shaped members. Walls 27, 28, 29 and 31 are preferably panes of transparent tempered glass. Other materials can be used to construct walls 27, 28, 29 and 31. The end portions of end walls 27, 28 and side walls 29, 31 are sealed together with a sealant such as tape or adhesive to prevent water leakage between end walls 27, 28 and side walls 29, 31. Similarly, the bottom portions of end walls 27, 28 and side walls 29, 31 are sealed to the bottom of frame 24 with a sealant to prevent water leakage.

Inner wall assembly 22 has a generally uniform height that is greater than the height of outer wall assembly 23. Inner wall assembly 22 surrounds a chamber 32 containing a burner assembly 33 operable to generate a flame. Water located between inner and outer wall assemblies 22 and 23 is contained within chamber 26. Water is pumped into chamber 26 through tubes 39 open to the bottom of chamber 26. Water may spill and flow out of chamber 26 over outer wall assembly 23 when air bubbles are created in the water. Overflowing water drains into a channel 34 of frame 24 surrounding outer wall assembly 23 and out a tube 36 to a liquid reservoir located below table top 21. Inner wall assembly 22 being taller than outer wall assembly 23 prevents water from flowing out of chamber 26 into burner chamber 32 as the level of water in chamber 26 is limited to the height of outer wall assembly 23. Water in chamber 26 cools inner and outer wall assemblies 22 and 23 whereby outer wall assembly 23 is cool to the touch.

Burner assembly 33 is a generally rectangular shaped member located in chamber 32 surrounded by inner wall assembly 22. Burner assembly 33 has a pan-shaped base 35 adapted to accommodate fire resistant glass beads and the like. Flanges 46 and 47 extending outwardly from base 35 are fastened to frame 24 with fasteners to mount burner assembly 33 on frame 24.

Air from an air supply is pumped into a tube 37 located in the bottom of chamber 26. Tube 37 has a plurality of small openings to allow the release of air into the water in chamber 26 to form air bubbles in the water that move rapidly upwardly to the top surface of the water.

A light strip 38 such as a LED waterproof light strip located along the bottom of channel 34 is operable to illuminate inner and outer wall assemblies 22 and 23, the water in chamber 26 and the air bubbles moving through the water in changing colors. Light strip 38 extends from a power supply through tubes 36 in frame 24 into channel 34. Light emanating from light strip 38 and burner assembly 33 reflects off air bubbles, water, glass beads and wall assemblies 22 and 23 in a dissimilar manner to create ambience and a relaxing atmosphere.

Figure 9:
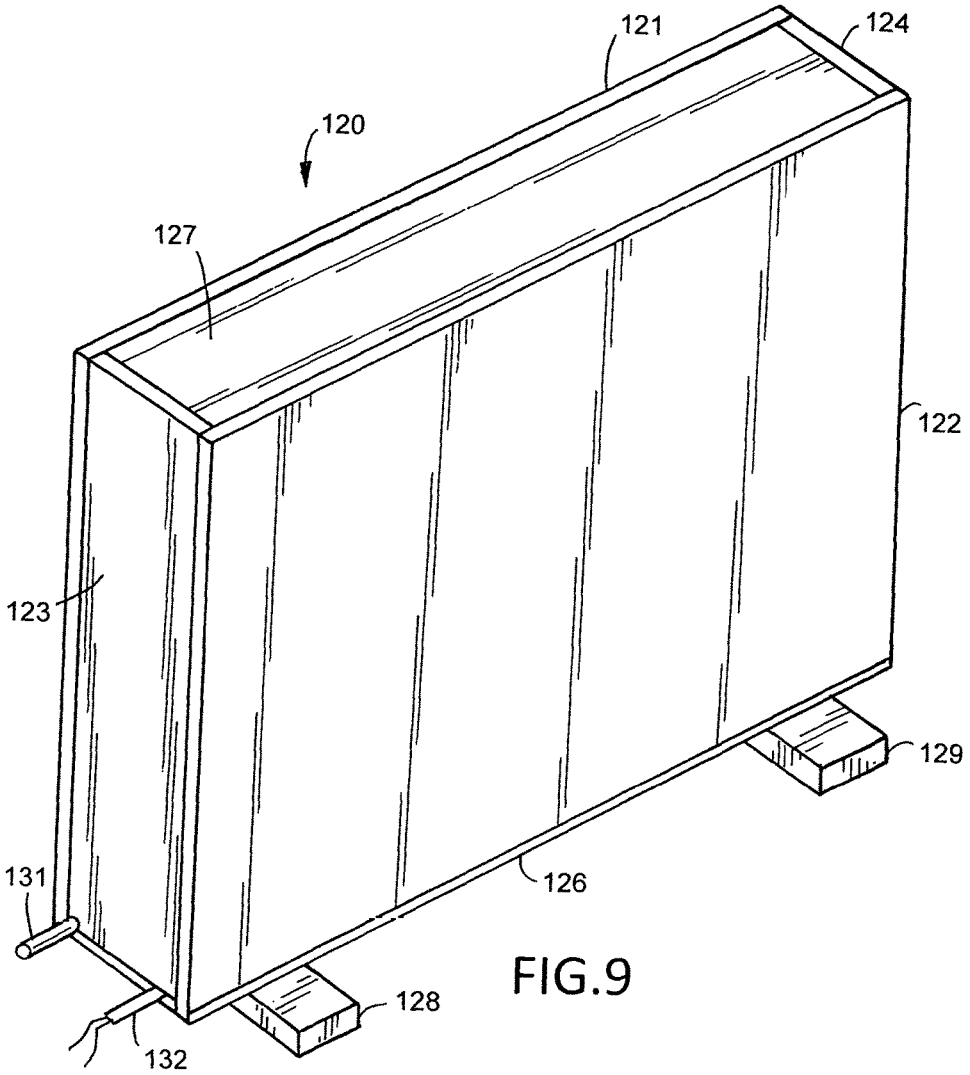
FIG. 9 is a perspective view of a modification of the aesthetic enhancement apparatus.
Figure 10:
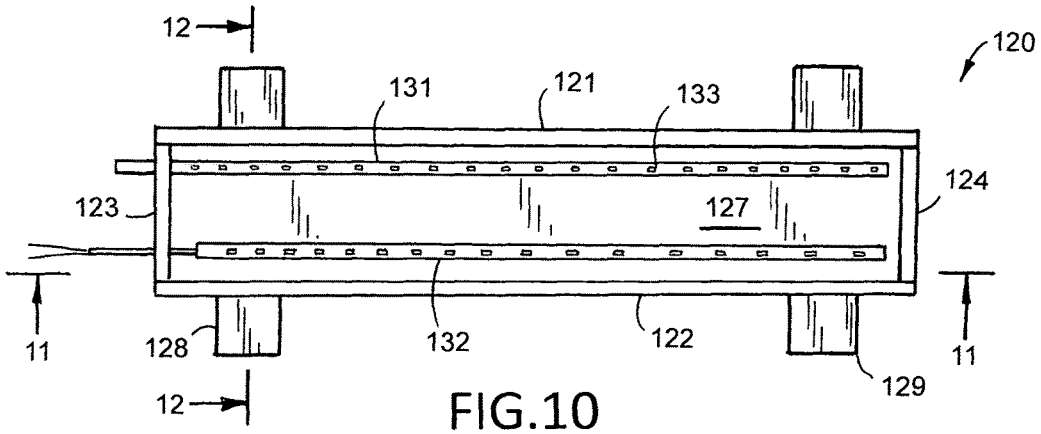
FIG. 10 is a top plan view of FIG. 9.
Figure 11:
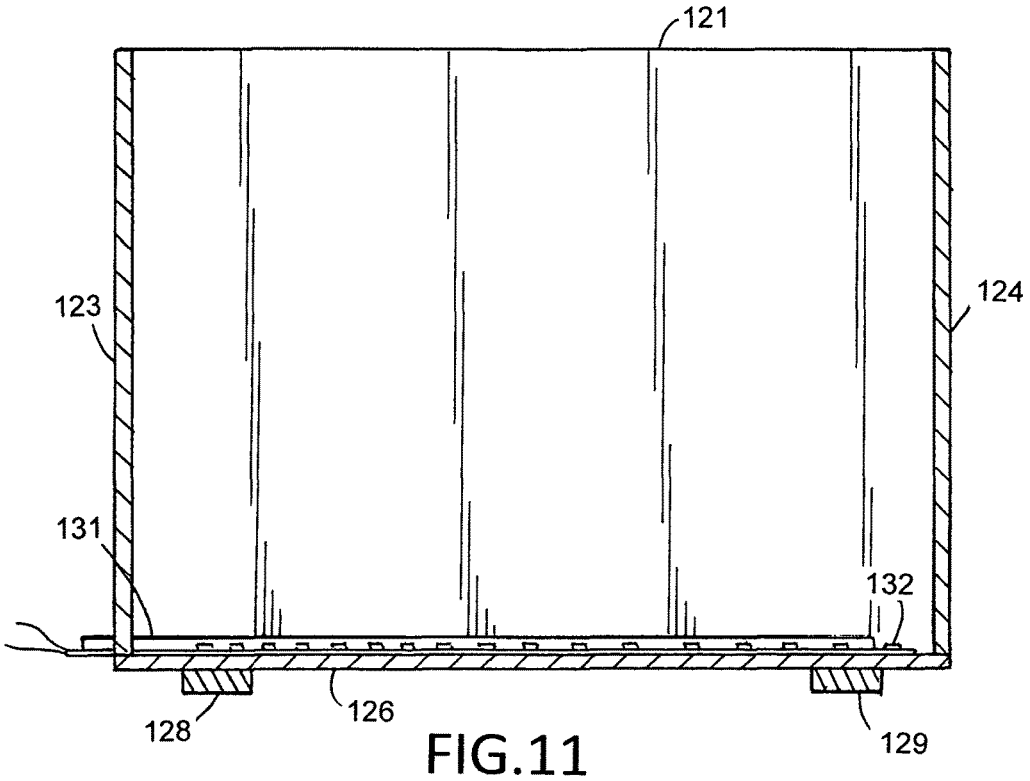
FIG. 11 is an elevated front view of FIG. 9.
Figure 12:
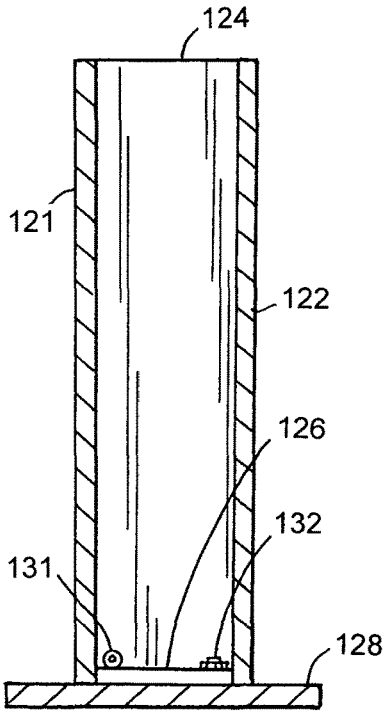
FIG. 12 is an elevated end view of FIG. 9.

A first modification of the aesthetic enhancement apparatus indicated generally at 120, is shown in FIGS. 9 to 12. Aesthetic enhancement apparatus 120 is useable to create atmosphere and ambience in outdoor and indoor living spaces. Apparatus 120 is a free standing portable unit that can be moved around a living space or stored in a storage area, if desired.

Aesthetic enhancement apparatus 120 has laterally spaced upright side walls 121 and 122 joined to end walls 123 and 124 and bottom wall 126 to define an inner chamber 127 for holding liquid such as water. Walls 121, 122, 123 and 124 are preferably panes of transparent tempered glass. Other materials can be used to construct walls 121-124. Side walls 121 and 122, end walls 123 and 123 and bottom wall 126 are sealed together to prevent water leakage from chamber 127. Supports 128 and 129 attached to bottom wall 126 extending outwardly from side walls 121 and 122 stabilize and retain apparatus 120 in an upright position.

An air tube 131 extends through end wall 123 of apparatus 120 into the bottom of chamber 127. Air is pumped from an air supply into tube 131. Tube 131 has a plurality of openings 133 to allow the release of air into the water in chamber 127 thereby forming air bubbles in the water that move upwardly to the top surface of the water.

A light strip 132 such as a waterproof LED light strip extends through end wall 123 of apparatus 120 into the bottom of chamber 127 adjacent tube 131. Light strip 132 is operable to illuminate walls 121-124, water in chamber 127 and the air bubbles moving through the water. Light from light strip 132 reflects off walls 121-124, water and air bubbles in a dissimilar manner to create ambience and a relaxing atmosphere.

The foregoing disclosure of the invention describes and illustrates a plurality of embodiments of the aesthetic enhancement apparatus of the invention. Modifications, changes in parts, arrangement of parts, materials and method operation may be made to the aesthetic enhancement apparatus and method defined in the claims herein by persons skilled in the art without departing from the invention.

The invention claimed is:

1. An aesthetic enhancement apparatus for a living space comprising:

a frame member, the frame member adapted to be mounted on a support surface, a first wall assembly and a second wall assembly laterally spaced from the first wall assembly, the first and second wall assemblies joined to the frame member to define a chamber for holding a liquid, a sealant located on adjacent end portions of the first and second wall assemblies and the frame member to prevent leakage of liquid from the chamber, a burner assembly mounted on the frame member, the first wall assembly surrounding the burner assembly, a tube member connected to an air supply, the tube member located in the chamber whereby air from the air supply is released into the liquid in the chamber to form air bubbles in the liquid, and a light source connected to a power supply, the light source located in the chamber, the light source operable to illuminate the first and second wall assemblies, air bubbles in the chamber and liquid in the chamber, the first wall assembly having a height that is more than the height of the second wall assembly to prevent liquid to flow out of the chamber into the burner assembly.

2. The aesthetic enhancement apparatus of claim 1 wherein:

the support surface is a table top having a central opening, the frame member being adapted to fit within the opening.

3. The aesthetic enhancement apparatus of claim 1 wherein:

the tube member has a plurality of openings to allow air from the air supply to be released into the liquid contained within the chamber to form air bubbles in the liquid.

4. The aesthetic enhancement apparatus of claim 1 wherein:

the first and second wall assemblies include walls of transparent tempered glass.

5. The aesthetic enhancement apparatus of claim 1 wherein:

the light source is a LED waterproof light strip.

6. The aesthetic enhancement apparatus of claim 1 including:

fire resistant glass beads located adjacent the burner assembly.

7. An aesthetic enhancement apparatus for a living space comprising:

a frame member, the frame member adapted to be mounted on a support surface, a first wall assembly and a second wall assembly laterally spaced from the first wall assembly, the first and second wall assemblies joined to the frame member to define a chamber for holding a liquid, a sealant located on adjacent end portions of the first and second wall assemblies and the frame member to prevent leakage of liquid from the chamber, a burner assembly mounted on the frame member, the first wall assembly surrounding the burner assembly, a tube member connected to an air supply, the tube member located in the chamber whereby air from the air supply is released into the liquid in the chamber to form air bubbles in the liquid, and a light source connected to a power supply, the light source located in the chamber, the light source operable to illuminate the first and second wall assemblies, air bubbles in the chamber and liquid in the chamber, the frame member having a channel member surrounding the second wall assembly to collect and drain liquid overflowing the second wall assembly.

8. An apparatus for aesthetically enhancing a living space comprising:

a channel shaped frame member, a first upright wall assembly, a second upright wall assembly laterally spaced outwardly from the first upright wall assembly, the first and second wall assemblies each having upright end walls and upright side walls joined to the channel shaped frame member to define a first outer chamber for holding a liquid, an overflow tube member connected to a liquid reservoir, the overflow tube member adapted to drain excess liquid from the first outer chamber into the liquid reservoir, a sealant located adjacent end portions of the upright end walls, the upright side walls and the channel shaped frame member to prevent leakage of liquid from the chamber between the upright end walls, the upright side walls and the channel shaped frame member, the upright end walls and the upright side walls of the first upright wall assembly surrounding a second inner chamber, a burner assembly located in the second inner chamber, the burner assembly operable to generate a flame visible within the second inner chamber, an air tube member located adjacent the bottom of the first outer chamber, the air tube member having a plurality of openings, the air tube member connected to an air supply, the air supply operable to supply air to the air tube member whereby air supplied from the air supply flows through the air tube member and out of the plurality of openings and is released into the liquid in the first outer chamber to form bubbles of air in the liquid, and a light source connected to a power supply, the light source operable to illuminate the bubbles of air and the liquid in the first outer chamber to create an aesthetically enhanced living space.

9. The apparatus of claim 8 including:

ledge members projecting outwardly from the channel shaped frame member adapted to accommodate fasteners to fasten the channel shaped frame member to a support surface.

10. The apparatus of claim 9 wherein:

the support surface is a table top having a central opening, the upright frame member fastened to the table top within the opening.

11. The apparatus of claim 8 wherein:

the upright end walls and the upright side wall of the first upright wall assembly each have a uniform height, the upright end walls and the upright side walls of the second upright wall assembly each have a uniform height being less than the uniform height of the upright end walls and the upright side walls of the first upright wall assembly.

12. The apparatus of claim 8 wherein:

the upright end walls and the upright side walls of the first upright wall assembly and the second upright wall assembly are transparent tempered glass walls.

13. The apparatus of claim 8 wherein:

the light source is a LED waterproof light strip located in the first outer chamber.

14. The apparatus of claim 8 wherein:

the burner assembly has a pan shaped base fastened to the channel shaped frame member to mount the burner assembly to the channel shaped frame member, and fire resistant glass beads located in the pan shaped base of the burner assembly.

* * * * *